US006318010B1

(12) United States Patent
Tsai

(10) Patent No.: US 6,318,010 B1
(45) Date of Patent: Nov. 20, 2001

(54) ORNAMENTAL CRYSTAL BALL

(76) Inventor: Jui-An Tsai, 3F-2, No. 1181, Kuo Chi Road, Section 1, Tao Yuan City (TW)

( * ) Notice: Subject to any disclaimer, the term of this patent is extended or adjusted under 35 U.S.C. 154(b) by 0 days.

(21) Appl. No.: 09/521,483

(22) Filed: Mar. 9, 2000

(51) Int. Cl.[7] ..... G09F 19/00
(52) U.S. Cl. ..... 40/406; 40/407; 40/410
(58) Field of Search ..... 40/406, 407, 412, 40/422, 439, 440, 441, 409, 410, 411, 414; 446/267

(56) References Cited

U.S. PATENT DOCUMENTS 2,072,841 * 3/1937 Tracey et al. ..... 40/407
4,771,902 * 9/1988 Teng ..... 40/410
4,817,311 * 4/1989 Ong ..... 40/410
5,396,723 * 3/1995 Liu ..... 40/407
5,442,869 * 8/1995 McDarren et al. ..... 40/410
6,027,774 * 2/2000 Fine et al. ..... 40/406

* cited by examiner

*Primary Examiner*—Lynne H. Browne
*Assistant Examiner*—Doug Hutton
(74) *Attorney, Agent, or Firm*—Dougherty & Troxell

(57) ABSTRACT

An ornamental crystal ball having an integrally injection molded plastic spherical liquid container supported on a seat is provided. The spherical liquid container defines a cylindrical inner space for containing clear liquids and floating ornaments. A portion of the spherical liquid container surrounding an opening of the inner space extends outward by a short distance to form a diameter-reduced tubular neck portion. An innermost end of the inner space has a curved surface so that no sharp line or pointed angle would appear in the inner space. A bottom cap seals the neck portion and includes a bubble collector and a motor compartment. The bubble collector collects bubbles possibly appearing in the inner space and the motor compartment has a motor mounted therein to rotate blades in the liquid of the inner space to create dynamic views in the ornamental crystal ball.

3 Claims, 6 Drawing Sheets

ORNAMENTAL CRYSTAL BALL

BACKGROUND OF THE INVENTION

The present invention relates to an ornamental crystal ball, and more particularly to an ornamental crystal ball that could be mass-produced through integral injection molding at reduced cost. The ornamental crystal ball includes a clear plastic spherical body that defines a generally cylindrical inner space in which liquids and floating articles are contained to achieve the same ornamental effect as that provided by a conventional ornamental crystal ball.

The ornamental crystal ball has been known for quiet a long time. FIGS. 1 and 2 are perspective and sectional views, respectively, of a conventional ornamental crystal ball 1. The conventional ornamental crystal ball 1 mainly includes a hollow ball-shaped container 11 in which clear liquids and various kinds of three-dimensional ornaments, such as antique dolls or currently popular dual-liquid floating ornaments 12 (that is, floating articles floating at joint of clear oil and colored water), are contained for ornamental purpose. A portion of the liquid container 11 outward extends by a short distance to form a tubular neck portion 13. The neck portion 13 has a diameter smaller than that of the ball-shaped container 11 and is sealed at its outer opening by a plug 14 and bonding agent 15 applied around the plug 14. A seat 16 is then connected to an outer periphery of the neck portion 13 to protectively shield the neck portion 13 and support the whole ball-shaped liquid container 11. Although the ornamental crystal ball is actually a substantially four-fifths ball 11 supported on the seat 16, it impresses consumers as a full ball. However, up to now, such hollow four-fifths ball could only be made of glass material through blow molding at considerably high cost. That is, the mass production such as injection molding could not be employed for such hollow four-fifths ball. Moreover, some types of liquid, such as kerosene oil and white wax oil, tend to have action on glass and produce white film on the glass. Therefore, the conventional ornamental crystal ball made of glass could not be used in the manner of a dual-liquid ornament.

FIG. 3 illustrates a product currently available in the market as a substitute for the ornamental crystal ball of FIGS. 1 and 2. The product of FIG. 3 includes a hollow liquid container 2 that could be mass-produced through injection molding into only a semi-spherical shell. That is, the liquid container 2 has an opening 21 located at the widest part of the container 2. The four-fifths ball shape and the reduced neck portion that are common on the conventional ornamental crystal ball are impossible on the liquid container 2. That is, the liquid container 2 does not impress consumers as a lovely spherical ornament.

SUMMARY OF THE INVENTION

It is therefore a primary object of the present invention to provide an improved ornamental crystal ball that could be mass-produced with plastic material through integral injection molding at lowered cost and provides the same ornamental effect as that could be provided by the conventional ornamental crystal ball made of glass.

The ornamental crystal ball of the present invention mainly includes a spherical liquid container and a seat for supporting the spherical liquid container thereon. The spherical liquid container is made of a clear plastic material through integral injection molding and defines a generally cylindrical inner space in which clear liquid or liquids and different three-dimensional floating ornaments are contained. A portion of the spherical liquid container surrounding an opening of the inner space extends outward to form a short tubular neck portion. The neck portion defines a bottom opening for the spherical liquid container and has an outer diameter smaller than that of the spherical liquid container and an inner diameter the same as that of the inner space. An innermost end of the inner space has a curved surface so that no sharp line or pointed angle would appear in the inner space. A bottom cap seals the bottom opening of the neck portion through supersonic welding. The seat is connected to an outer periphery of the neck portion to protectively shield the neck portion and stably support the whole spherical liquid container.

Another object of the present invention is to provide the above ornamental crystal ball that further includes a bubble collector and a motor compartment at the bottom cap. The bubble collector collects bubbles possibly appearing in the inner space. The motor compartment has a battery-powered, low-current and watertight motor mounted therein, so that the motor drives blades connected thereto to rotate in the liquid filled in the inner space to create dynamic views in the ornamental crystal ball.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
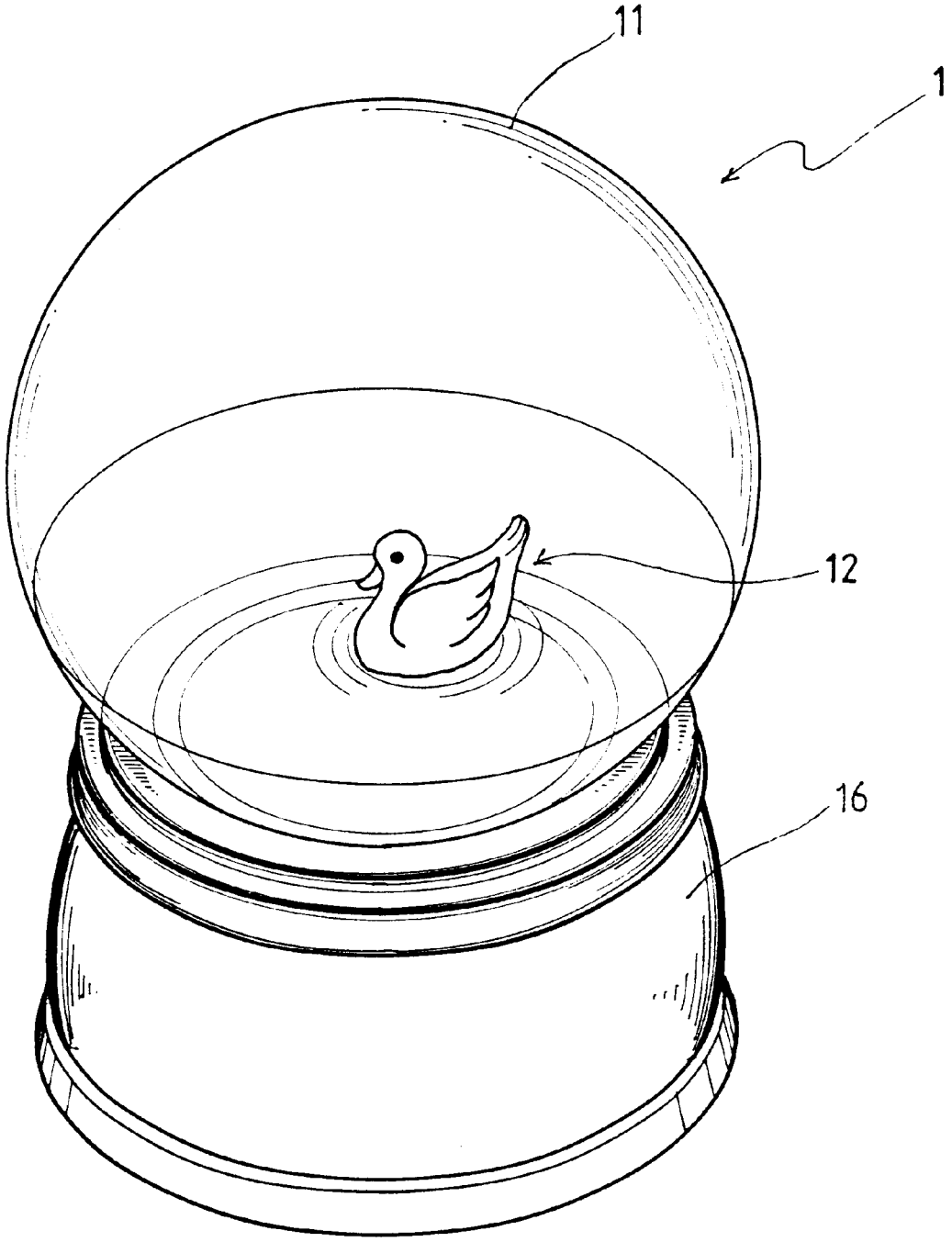
PRIOR ART FIG. 1
FIG. 1 is a perspective of a conventional ornamental crystal ball.
Figure 2:
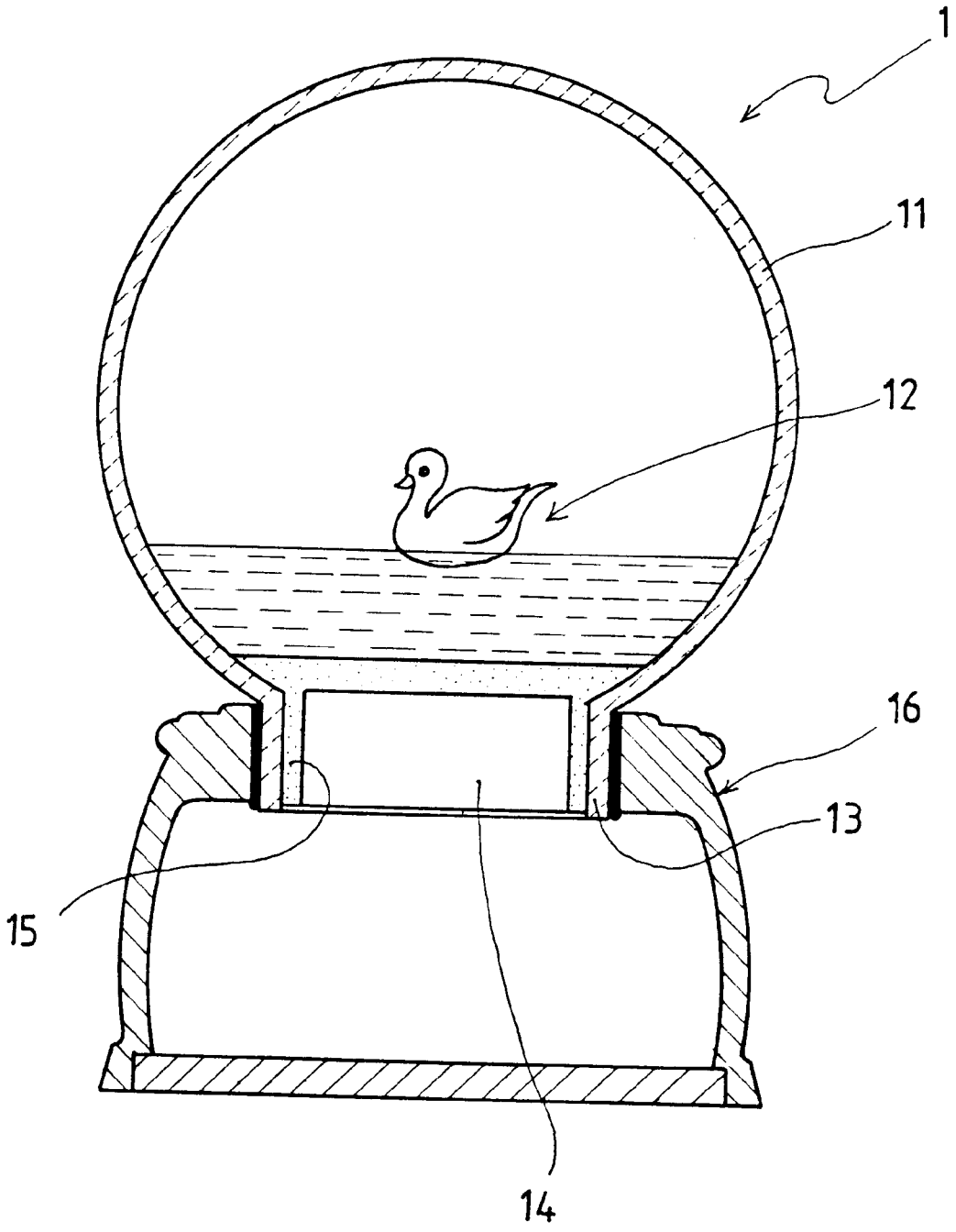
PRIOR ART FIG.2
FIG. 2 is a sectional view of the ornamental crystal ball of FIG. 1.
Figure 3:
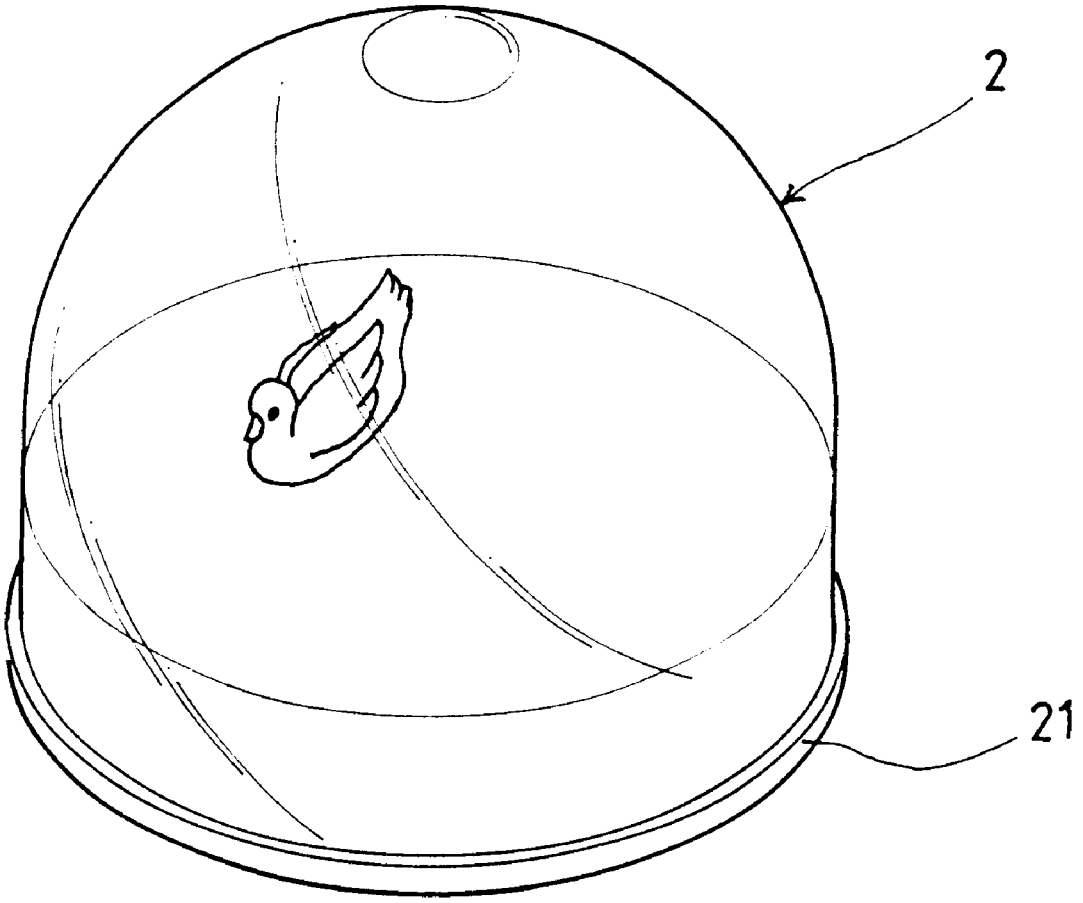
PRIOR ART FIG.3
FIG. 3 is a perspective of a conventional ornament having a semi-spherical configuration to substitute for a crystal ball.
Figure 4:
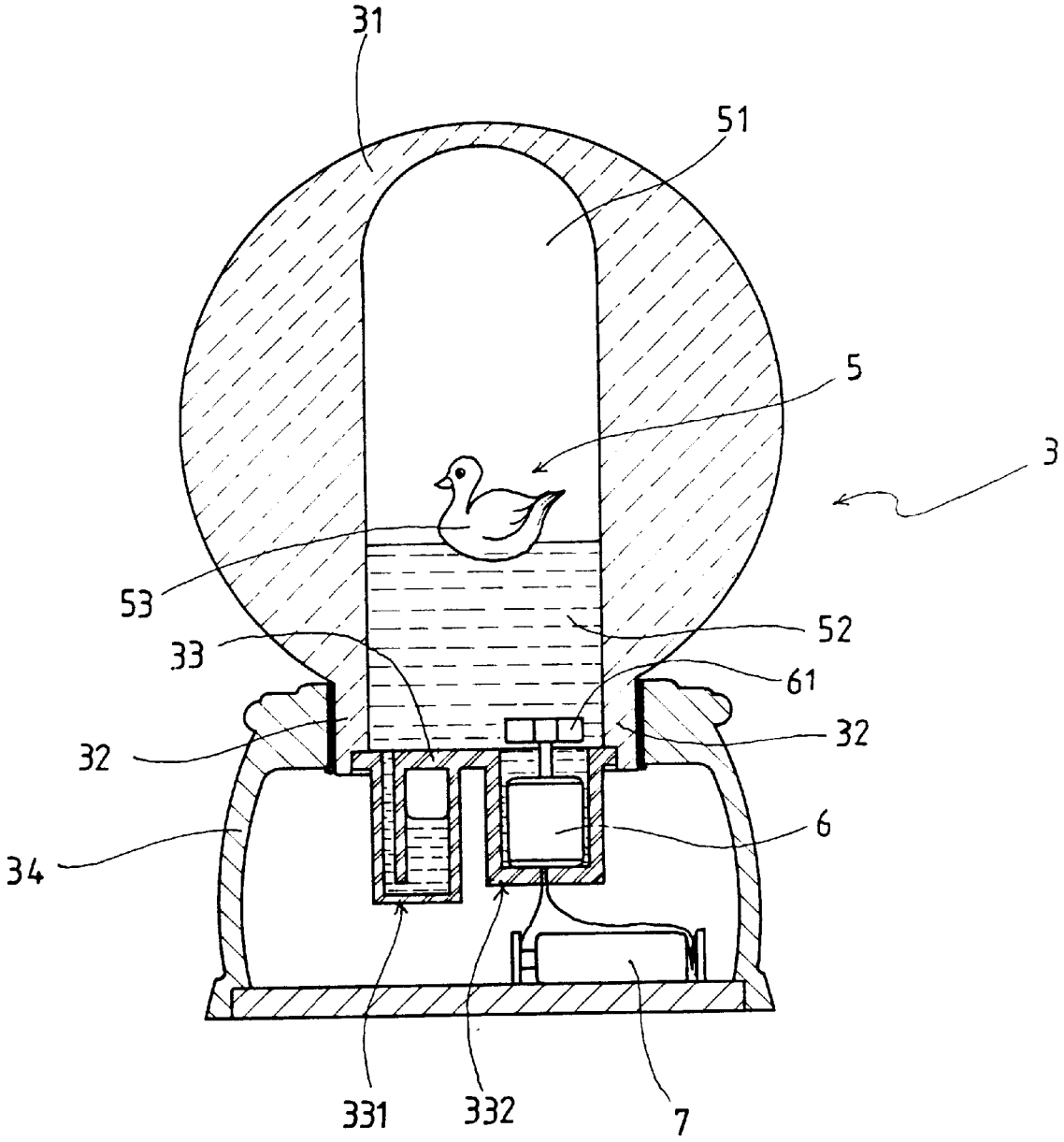
FIG. 4 is a sectional view of an ornamental crystal ball according to an embodiment of the present invention.
Figure 5:
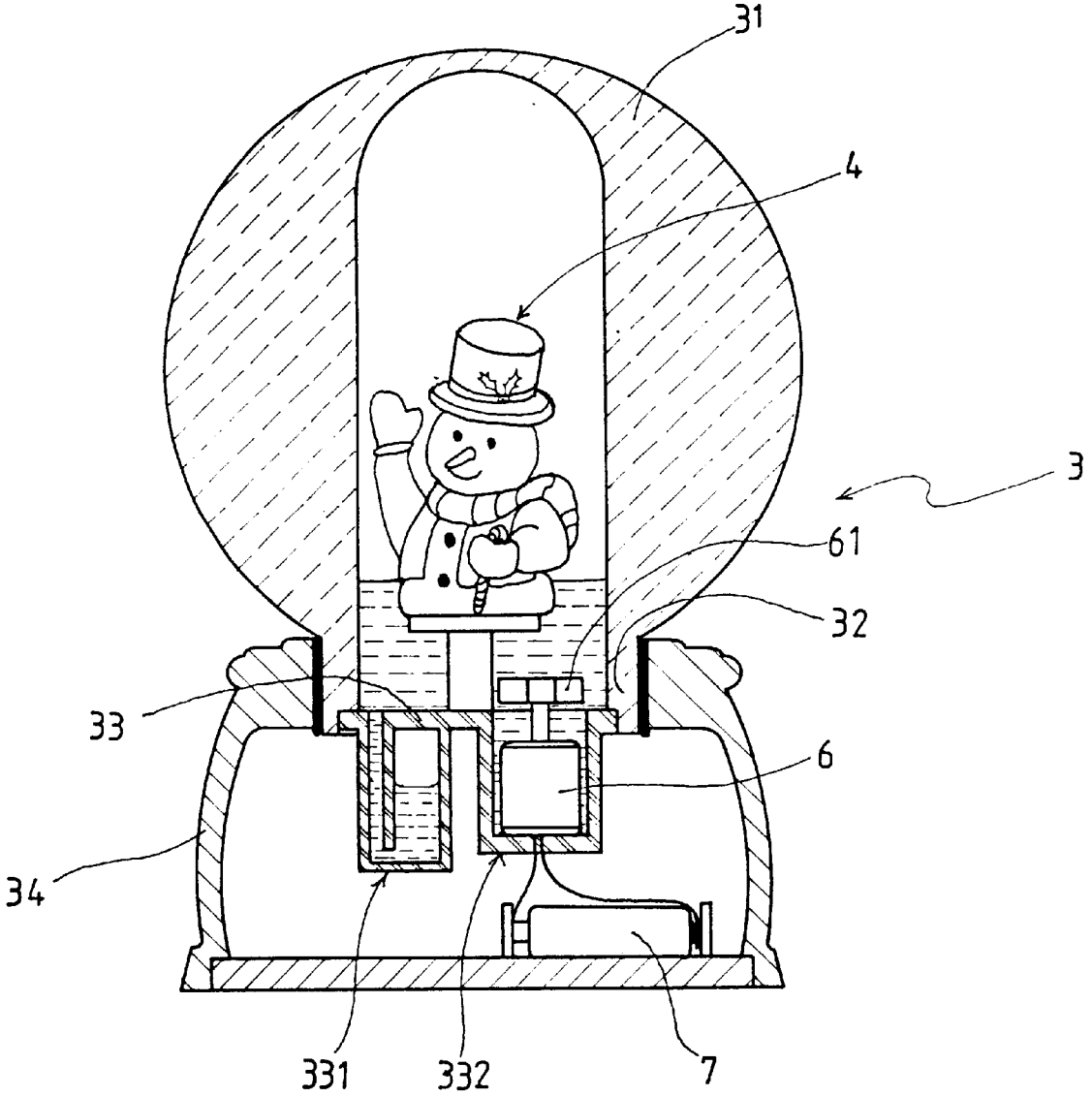
FIG. 5 is a sectional view of an ornamental crystal ball according to another embodiment of the present invention.

Please refer to FIGS. 4 and 5 that are sectional views of ornamental crystal balls 3 according to two embodiments of the present invention. As shown, the ornamental crystal ball 3 of the present invention mainly includes a spherical liquid container 31 defining a cylindrical inner space 35 (see FIG. 6). The inner space 35 may be filled with clear oil 51 and colored water 52 for one or more differently shaped floating articles 53 to float at a joint of the oil 51 and the water 52, so that a currently popular dual-liquid ornament 5 is provided in the spherical liquid container 31, as shown in FIG. 4. Alternatively, the inner space 35 may be filled with only one type of clear liquid and one or more differently shaped 3D ornamental articles, as shown in FIG. 5. A portion of the spherical liquid container 31 surrounding an opening of the inner space 35 extends outward to form a short tubular neck portion 32. The neck portion 32 has an outer diameter smaller than that of the spherical liquid container 31 and an inner diameter the same as that of the cylindrical inner space 35. The neck portion 32 also defines a bottom opening for the spherical liquid container 31. A bottom cap 33 is fitly disposed in the bottom opening of the neck portion 32 to seal the same in a watertight manner. A seat 34 is connected to an outer periphery of the neck portion 32 to protectively shield the neck portion 32 and stably support the whole spherical liquid container 31. The seat 34 may have differently designed configurations or be differently decorated to provide changeful appearances. The ornamental crystal ball 3 of the present invention is therefore almost the same as the conventional ornamental crystal ball in terms of the ornamental effect and overall appearance thereof.

Figure 6:
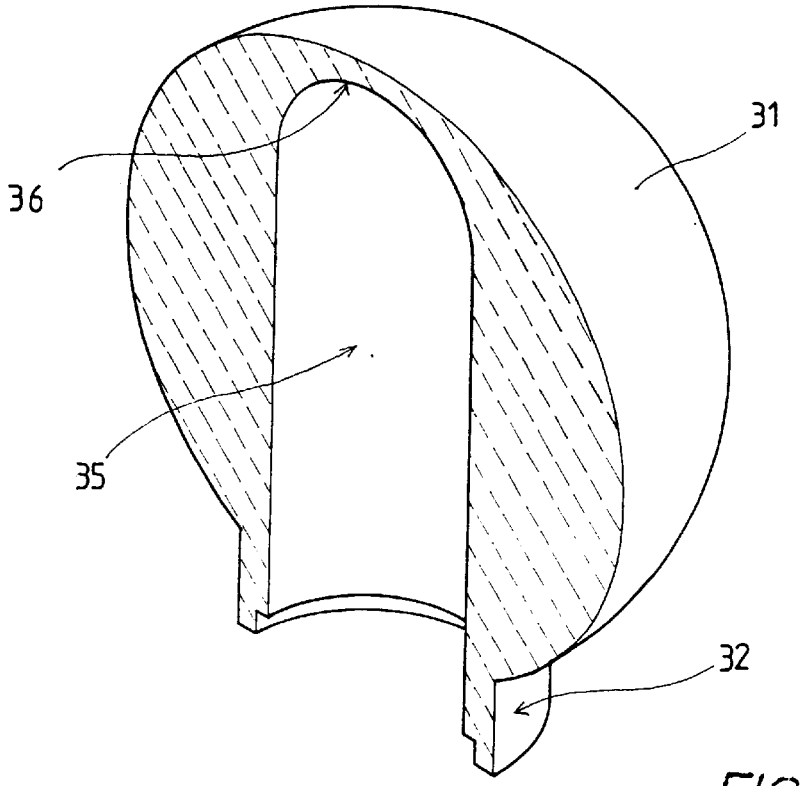
FIG. 6 is a partially cutaway perspective of the spherical liquid container of the ornamental crystal ball of the present invention showing internal structure thereof.
Figure 7:
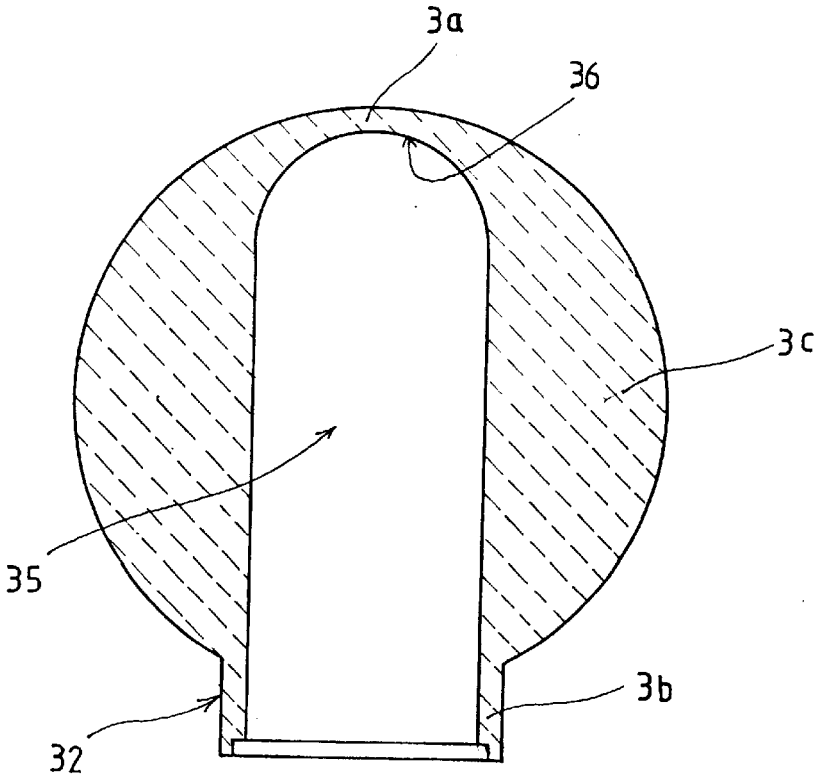
FIG. 7 is a sectional view of the spherical liquid container of FIG. 6.

Please refer to FIGS. 6 and 7 at the same time. The ornamental crystal ball 3 of the present invention is characterized in that the liquid container 31 is a spherical member having a cylindrical inner space 35 and an appearance close to a full ball as a real crystal ball. The inner space 35 straightly extends from the opening of the reduced neck portion 32 into the spherical liquid container 31 to maintain an inner diameter the same as that of the neck portion 32. The inner space 35 preferably has a curved innermost end 36, so that there is not any sharp line or pointed angle in the inner space 35 and no contact surface between the liquid container 31 and the inner space 35 is visible from outside of the spherical liquid container 31 after the liquid container 31 is filled with liquid. This design allows the whole spherical liquid container 31 to be mass-produced with clear plastic material through integral injection molding and at lowered cost.

Please refer back to FIGS. 4 and 5. The bottom cap 33 may also be made of plastic material for efficiently connecting it to the open end of the neck portion 32 through supersonic welding to prevent liquid leakage without the need of applying bonding agent around the joint between the neck portion 32 and the bottom cap 33.

Please refer to FIG. 7 again. In a preferred embodiment of the present invention, the spherical liquid container 31 has an outer diameter of 85 mm, a wall thickness at a top portion 3*a* of the liquid container 31 is preferably 2 mm to 3 mm, the inner diameter of the inner space 35 and the neck portion 32 is preferably 30 mm, and a wall thickness 3*b* of the neck portion 32 is preferably 2.5 mm. These dimensions all are obtainable through integral injection molding. Moreover, a thickest portion 3*c* on the spherical liquid container 31 is about 25 mm in thickness. This thickness enables the spherical liquid container 31 to best magnify ornamental articles in the container 31.

The bottom cap 33, in addition to its basic function of sealing the neck portion 32, may be designed to provide other functions to meet market demands. As shown in FIGS. 4 and 5, the bottom cap 33 has integrally provided bubble collector 331 and motor compartment 332. The bubble collector 331 may collect bubbles possibly appear in the inner space 35 to avoid adverse influence of the bubbles on the display effect of the ornamental crystal ball 3. The motor compartment 332 has a watertight and low-current motor 6 mounted therein to be powered by external batteries 7. When the motor 6 is switched on, blades 61 connected to the motor 6 and extended into the inner space 35 are driven to rotate and thereby stir liquid filled in the inner space 35, causing the floating ornamental articles 4 or 53 in the inner space 35 to move and create dynamic and interesting views in the ornamental crystal ball 3 to produce very good ornamental effect.

What is claimed is:

1. An ornamental crystal ball, comprising a spherical liquid container and a seat for supporting said spherical liquid container thereon;

said spherical liquid container being made of a clear plastic material through integral injection molding and defining a generally cylindrical inner space in which clear liquid or liquids and different three-dimensional floating ornaments are contained; a portion of said spherical liquid container surrounding an opening of said inner space extending outward to form a short tubular neck portion, said neck portion having an outer diameter smaller than that of said spherical liquid container and an inner diameter the same as that of said inner space; an innermost end of said inner space having a curved surface so that no sharp line or pointed angle would appear in said inner space; and a bottom cap being fitly disposed in an outer opening of said neck portion to seal said neck portion in a watertight manner; and said seat being connected to an outer periphery of said neck portion to protectively shield said neck portion and stably support said whole spherical liquid container.

2. An ornamental crystal ball as claimed in claim 1, wherein said bottom cap is made of a plastic material and is connected to said outer opening of said neck portion of said spherical liquid container through supersonic welding to seal said outer opening of said neck portion.

3. An ornamental crystal ball as claimed in claim 1, wherein said bottom cap is integrally provided with a bubble collector for collecting bubbles possibly appearing in said inner space and a motor compartment for receiving a battery-powered, low-current and watertight motor, so that said motor drives blades connected thereto to rotate in liquid filled in said inner space to create dynamic views in said ornamental crystal ball.

* * * * *